US007160436B2

(12) United States Patent
Benazzi et al.

(10) Patent No.: US 7,160,436 B2
(45) Date of Patent: Jan. 9, 2007

(54) METHOD FOR TWO-STEP HYDROCRACKING OF HYDROCARBON FEEDSTOCKS

(75) Inventors: Eric Benazzi, Chatou (FR); Jean-Marie Deves, Vernouillet (FR); Pierre Marion, Chatou (FR); Christophe Gueret, Saint Romain en Gal (FR); Alain Billon, le Vesinet (FR); Patrick Bourges, Rueil-Malmaison (FR)

(73) Assignee: Institut Francais du Petrole, Rueil Malmaison Cedex (FR)

( * ) Notice: Subject to any disclaimer, the term of this patent is extended or adjusted under 35 U.S.C. 154(b) by 468 days.

(21) Appl. No.: 10/343,218

(22) PCT Filed: Jul. 26, 2001

(86) PCT No.: PCT/FR01/02447

§ 371 (c)(1),
(2), (4) Date: Sep. 26, 2003

(87) PCT Pub. No.: WO02/10315

PCT Pub. Date: Feb. 7, 2002

(65) Prior Publication Data

US 2004/0045869 A1 Mar. 11, 2004

(30) Foreign Application Priority Data

Jul. 31, 2000 (FR) ..... 00 10095

(51) Int. Cl.
*C10G 65/12* (2006.01)
*C10G 37/02* (2006.01)

(52) U.S. Cl. ..... 208/59; 208/58; 208/89; 208/111

(58) Field of Classification Search ..... 208/58, 208/59, 89, 111; 502/79
See application file for complete search history.

(56) References Cited

U.S. PATENT DOCUMENTS

| | | | | |
|---|---|---|---|---|
| 3,702,818 | A * | 11/1972 | Streed et al. | 208/89 |
| 3,816,296 | A | 6/1974 | Hass et al. | |
| 4,713,167 | A * | 12/1987 | Reno et al. | 208/59 |
| 5,190,903 | A * | 3/1993 | Steigleder | 502/79 |
| 5,228,979 | A | 7/1993 | Ward | |
| 6,171,474 | B1 | 1/2001 | Kasztelan et al. | |

FOREIGN PATENT DOCUMENTS

| | | |
|---|---|---|
| EP | 0 955 091 A1 | 11/1999 |
| EP | 0955091 | 11/1999 |
| GB | 1229432 | 4/1971 |

* cited by examiner

*Primary Examiner*—Glenn Caidarola
*Assistant Examiner*—Prem C. Singh
(74) *Attorney, Agent, or Firm*—Millen, White, Zelano & Branigan, P.C.

(57) ABSTRACT

An improved hydrocracking process of hydrocarbon charges, in two stages with an intermediate separation, in which the second-stage of hydrocracking is carried out in the presence of an added nitrogen content which is greater than 150 ppm by weight, preferably about 500 ppm by weight, and preferably in the presence of a Y zeolite catalyst, produces high yields of middle distillate.

24 Claims, 5 Drawing Sheets

METHOD FOR TWO-STEP HYDROCRACKING OF HYDROCARBON FEEDSTOCKS

The present invention relates to an improved hydrocracking process of hydrocarbon charges, a process in two-stages with intermediate separation, in which the second-stage of hydrocracking is carried out in the presence of an added nitrogen content which is greater than 110 ppm by weight.

The aim of the process is essentially the production of middle distillates, that is to say of fractions with an initial boiling point of at least 150° C. and a final boiling point reaching to just before the initial boiling point of the residue, for example lower than 340° C., or also lower than 370° C.

PRIOR ART

The hydrocracking of heavy petroleum fractions is a very important refining process which permits the production, starting from excess heavy charges which are not very exploitable, of lighter fractions such as gasolines, jet engine fuels and light gas-oils sought by the refiner to adapt his production to the structure of demand. Some hydrocracking processes make it possible to also obtain a highly purified residue which can provide excellent bases for oils. In comparison to catalytic cracking, the advantage of catalytic hydrocracking is that it delivers very high quality middle distillates, jet engine fuels and gas-oils. Conversely, the gasoline produced has a much lower octane index than that produced by catalytic cracking.

Hydrocracking is a process which derives its flexibility from three main elements which are the operating conditions used, the types of catalysts used and the fact that the hydrocracking of hydrocarbon charges can be carried out in one or two-stages. In fact, hydrocracking is a process which can assume various forms of which the main ones are:

Single-stage hydrocracking, which firstly and generally comprises an intensive hydrotreatment which has the aim of carrying out an intensive hydrodenitrogenation and an intensive desulphurization of the charge before it is sent on to the hydrocracking catalyst proper, in particular in the event it comprises a zeolite. This intensive hydrotreatment of the charge involves only a limited conversion of the charge, into lighter fractions, which remains insufficient and must therefore be completed on the more active hydrocracking catalyst. However, it should be noted that no separation occurs between the two types of catalyst. All of the effluent leaving the reactor is injected onto the hydrocracking catalyst proper and it is only then that a separation of the products formed is realized. This single-stage hydrocracking, also called "once through" hydrocracking, has a variant which includes a recycling of the unconverted fraction to the reactor with a view to a more complete conversion of the charge.

Two-stage hydrocracking comprises a first stage which as in the "one-stage" process, has the aim of carrying out the hydrorefining of the charge but also achieving a conversion of the latter that is generally of the order of 40 to 60%. The effluent from the first stage then undergoes a separation (distillation) most often called intermediate separation, which has the aim of separating the conversion products from the unconverted fraction. In the second-stage of a 2-stage hydrocracking process, only the fraction of the charge which is not converted during the first stage is treated. This separation allows a two-stage hydrocracking process to be more selective in diesel than a single-stage process. In fact, the intermediate separation of the conversion products prevents their "over-cracking" into naphtha and gas in the second-stage on the hydrocracking catalyst. Furthermore, it should be noted that the unconverted fraction of the charge treated in the second-stage generally contains very low $NH_3$ levels and of organic nitrogen compounds, in general less than 20 ppm by weight or even less than 10 ppm by weight. In a standard manner, the 2-stage process can be carried out either with an intermediate separation after hydrorefining, in a process comprising a hydrorefining reactor and a hydrocracking reactor, or with an intermediate separation between the first and the second hydrocracking reactors in a process in which the hydrorefining $1^{st}$ hydrocracking, $2^{nd}$ hydrocracking reactors are in series.

The hydrocracking catalysts used in the hydrocracking processes are all of the bifunctional type combining an acid function with a hydrogenating function. The acid function is provided by large surfaced supports (generally 150 to 800 $m^2.g^{-1}$) presenting a superficial acidity, such as halogenated (in particular chlorinated or fluorinated) aluminas, combinations of boron and aluminium oxides, amorphous silica-aluminas and zeolites. The hydrogenation function is provided either by one or more metals of group VIII of the periodic table of elements, or by combination of at least one metal of group VIB of the periodic table and at least one group VIII metal.

In general, these catalysts are present downstream of the hydrotreatment reactor in the single-stage hydrocracking processes or in the second-stage of the 2-stage hydrocracking processes. However, they can also be present in the first hydrocracking stage.

The choice of catalysts to be used in the different types of hydrocracking process and in the different stages in the case of a two-stage process will depend in particular, on the type of charge to be treated as well as the aim assigned to the hydrocracker: maxi-gasoline or maxi middle distillate (kerosene+gas-oil).

Generally, the balance between the two functions, acid and hydrogenation, is the fundamental parameter which governs the activity and the selectivity of the catalyst. A weak acid function and a strong hydrogenation function give not very active catalysts, working at generally high temperatures (greater than or equal to 390° C.), and at low spatial feed rates (the VVH expressed as a volume of the charge to be treated per volume unit of the catalyst per hour is generally lower than or equal to 2 $h^{-1}$) but displaying a very good selectivity as regards middle distillates. Conversely, a strong acid function and a weak hydrogenation function produce active catalysts which do however, display less satisfactory selectivities as regards middle distillates. The search for a suitable catalyst will therefore be centred on a judicious choice of each of the functions to adjust the activity/selectivity combination of the catalyst.

Therefore, one of the great advantages of hydrocracking is that it displays great flexibility at various levels: flexibility regarding the hydrocracking process to be used, the catalysts used, which lead to a flexibility in the charges to be treated and a diversity in the selectivity of the products obtained.

A first type of conventional catalytic hydrocracking catalysts is based on low-acidity amorphous supports, such as amorphous silica-aluminas for example. These systems are more particularly used to produce very high quality middle distillates, and also, when their acidity is very weak, oil bases. These catalysts are in general used in the two-stage processes.

The family of the amorphous silica-aluminas is found in low-acidity supports.

Many hydrocracking catalysts are based on silica-alumina, combined either with a group VIII metal or, preferably when the heteroatomic toxin content of the charge to be treated exceeds 0.5% by weight, with a combination of metal sulphides of groups VIB and VIII. These systems have a very good selectivity in respect of middle distillates, and the products formed are of good quality. These catalysts, or the less acid among them, can also produce lubricating bases. The drawback of all of these catalytic systems based on an amorphous support is, as already mentioned, their low activity.

Other conventional catalysts comprising the Y zeolite of structural type FAU, or the beta-type catalysts have a catalytic activity better than that of the amorphous silica-aluminas, but displays greater selectivities in respect of light products. These catalysts are in general used in the "once through" single-stage processes or with recycling of the unconverted fraction. They have also been used in the second-stage of a two-stage hydrocracking process.

According to the prior art, all these 2-stage processes operate in the absence of ammonia (or its quasi-absence) from the $2^{nd}$ hydrocracking reactor, and this is essentially for two reasons. The first reason is that, in the absence of ammonia, the $2^{nd}$ hydrocracking reactor can function at a lower temperature than the $1^{st}$reactor (270–370° C. and 300–450° C. respectively). The second reason is that the absence of ammonia allows the use in the $2^{nd}$ stage of catalysts with noble metals or metal sulphides. This absence or quasi-absence of ammonia has always been proposed and used.

However, U.S. Pat. No. 3,816,296 teaches that it is possible, when using a catalyst optionally comprising a zeolite, to increase the selectivity in respect of middle distillates of the second-stage of hydrocracking a hydrocarbon charge containing less than 10 ppm by weight organic nitrogen by adding to the latter a quantity of nitrogen (from ammonia or amines with less than 15 carbon atoms) of between 15 and 100 ppm by weight (relative to the charge). The quantity of nitrogen added must therefore be strictly controlled and maintained within these limits.

Contrary to the prior art, the research work carried out by the applicant has led to the discovery that, surprisingly, in a 2-stage process the quantity of nitrogen added to obtain clearly improved selectivity in respect of middle distillates could be increased well above 110 ppm by weight of nitrogen, whilst retaining good catalytic activity, even though a catalyst comprising a Y zeolite is used in the second-stage of the process.

DETAILED DESCRIPTION OF THE INVENTION

More specifically, the invention describes a 2-stage hydrocracking process of hydrocarbon charges, comprising a first stage including a hydrorefining, an intermediate separation of the converted products, and a second-stage of hydrocracking of at least part of the residue, the said second-stage operating in the presence of ammonia in a quantity corresponding to more than 100 ppm nitrogen and advantageously the quantity of nitrogen is greater than 150 ppm and preferably greater than 200 ppm. Generally, it is at the most 1000 ppm, or at the most 800 ppm, or at the most 500 ppm.

The presence of ammonia in these quantities allows significant gains for the selectivity in respect of middle distillates of the zeolitic catalyst, a selectivity which therefore becomes comparable to that of amorphous catalysts containing for example an amorphic silica as acid function. The improved selectivity is obtained with reasonable increases in reaction temperatures whilst preserving the stability of the zeolite, that is to say the duration of the catalyst cycle. It has also been found that the selectivity in respect of gas-oil (for example of fraction points 250–380° C.) is greater for high quantities of nitrogen (more than 150 ppm, or better still more than 200 ppm by weight).

The additional presence of ammonia is obtained by direct injection of ammonia or also by injection of a nitrogen compound which breaks down into ammonia in the reaction conditions, the injection taking place directly into the reactor and for example at several points of the reactor, or preferably into the charge entering this reactor. Numerous nitrogen compounds can be used, for example aniline.

First Stage

Very varied charges can be treated by the process according to the invention and generally they contain at least 20% by volume and often at least 80% by volume of compounds which boil above 340° C.

The charge can be for example LCO (light cycle oil), atmospheric distillates, distillates under vacuum for example gas-oil from the direct distillation of the crude or conversion units such as FCC, coker or visbreaker, as well as charges originating from units extracting aromatics from lubricating oil bases or resulting from the solvent based removal of paraffins from lubricating oil bases, or distillates originating from desulphurization or hydroconversion of ATR (atmospheric residues) and/or RUV (residues under vacuum), or the charge can be a deasphalted oil, or any mixture of the charges previously mentioned. The list above is not limitative. In general, the charges have an initial boiling point greater than 340° C., and better still greater than 370° C.

The nitrogen content is usually between 1 and 5000 ppm by weight, more generally between 200 and 3000 ppm by weight, and the sulphur content between 0.1 and 5% by weight, more generally between 0.2 and 4%.

In the first stage the charge undergoes at least one hydrorefining (hydrodesulphurization, hydrodenitrogenation, conversion). Standard catalysts can be used, which contain at least one amorphous support and at least one hydro-dehydrogenating element (generally at least one non-noble element from the groups VIB and VIII, and most frequently at least one element from group VIB and at least one non-noble element from the VIII group)

In a very advantageous manner, in the two-stage hydrocracking process, according to the invention, the charge to be treated is placed in contact, in the presence of hydrogen, with a hydrorefining catalyst comprising at least one matrix, at least one hydro-dehydrogenating element chosen from the group formed by the elements of group VIB and group VIII of the periodic table, optionally at least one promoter element deposited on the catalyst and chosen from the group formed by phosphorus, boron and silicon, optionally at least one element from group VIIA (preferably chlorine and fluorine), and optionally at least one element from group VIIB (preferably manganese), optionally at least one element from group VB (preferably niobium).

Preferably, this catalyst contains boron and/or silicon as a promoter element, plus optionally phosphorus as another promoter element. The boron, silicon and phosphorus contents are therefore from 0.1–20%, preferably 0.1–15%, and even more advantageously 0.1–10%.

The matrices which can be used on their own or in a mixture are, by way of non limitative example, alumina, halogenated alumina, silicon, silica-alumina, clays (for example the natural clays such as kaolin or bentonite), magnesium, titanium oxide, boron oxide, zirconia, aluminium phosphates, titanium phosphates, zirconium phosphates, carbon and aluminates.

The use of matrices containing alumina is preferred, in all these forms known to a person skilled in the art, and in an even more preferred manner aluminas, for example gamma alumina.

The role of hydro-dehydrogenating function is preferably fulfilled by at least one non-noble metal or metal compound from groups VI and VIII preferably chosen from among molybdenum, tungsten, nickel and cobalt. Preferably, this function is fulfilled by the combination of at least one element of GVIII (Ni, Co) with at least one element of group VIB (Mo, W).

This catalyst can advantageously contain phosphorus; in fact it is known in the prior art that this compound gives the hydrotreatment catalysts two advantages: an ease of preparation notably during the impregnation of the nickel and molybdenum solutions, and a better hydrogenation activity.

In a preferred catalyst, the total concentration of oxides of metals of groups VI and VIII between 5 and 40% by weight and preferably between 7 and 30% and the weight ratio expressed as metal oxide of metal (or metals) of group VIB to metal (or metals) group VIII is preferably between 20 and 1.25 and even more preferably between 10 and 2. The concentration of phosphorus oxide $P_2O_5$ will be lower than 15% by weight and preferably 10% by weight.

Another preferred catalyst which contains boron and/or silicon (and preferably boron and silicon), generally contains, in % by weight relative to the total mass of the catalyst, at least one metal chosen from the following groups and with the following contents:

- 3 to 60%, preferably from 3 to 45% and in an even more preferred manner from 3 to 30% of at least one metal of group VIB and optionally,
- 0 to 30%, preferably from 0 to 25% and in an even more preferred manner from 0 to 20% of at least one metal of group VIII,
- the catalyst also containing at least one support chosen from the following groups with the following contents:
  - 0 to 99%, advantageously 0.1 to 99%, preferably from 10 to 98% and in an even more preferred manner from 15 to 95% of at least one amorphous or poorly crystallized matrix, the said catalyst being characterised in that it also contains,

- 0.1 to 20%, preferably from 0.1 to 15% and in an even more preferred manner from 0.1 to 10% boron and/or 0.1 to 20%, preferably from 0.1 to 15% and in an even more preferred manner from 0.1 to 10% silicon and optionally,
- 0 to 20%, preferably from 0.1 to 15% and in an even more preferred manner from 0.1 to 1 0% phosphorus, and optionally also,
- 0 to 20%, preferably from 0.1 to 15% and in an even more preferred manner from 0.1 to 10% of at least one element chosen from group VIIA, preferably fluorine.

In a general manner, formulas having the following atomic ratios are preferred:

- an atomic ratio of the group VIII metal to the group VIB metals of between 0 and 1,
- an atomic ratio B/metals of group VIB comprised between 0.01 and 3,
- an atomic ratio Si/metals of group VIB comprised between 0.01 and 1.5,
- an atomic ratio P/metals of group VIB comprised between 0.01 and 1,
- an atomic element ratio of the VIIA/metals group of group VIB comprised between 0.0 1 and 2.

In terms of the hydrogenation of the aromatic hydrocarbons and of hydrodenitrogenation and hydrosulphurization, such a catalyst has a greater activity than the catalytic formulas without boron and/or silicon, and also has an activity and selectivity as regards hydrocracking greater than the catalytic formulas known in the prior art. The catalyst with boron and silicon is particularly advantageous. Without wishing to be tied down by any particular theory, it seems that this particularly high activity of the catalysts with boron and silicon is due to the strengthening of the acidity of the catalyst by the joint presence of boron and silicon on the matrix which induces on one hand an improvement in the hydrogenating, hydrodesulphurizing, hydrodeazoting properties and on the other hand an improvement in the hydrocracking activity in comparison with catalysts normally used in the hydrorefining reactions of hydroconversion.

The preferred catalysts are the NiMo and/or NiW catalysts on alumina, and also the NiMo and/or NiW catalysts on alumina doped with at least one element included in the group of atoms formed by phosphorus, boron, silicon and fluorine, or the NiMo and/or NiW catalysts on silica-amina, or on silica-alumina-titanium oxide doped or not by at least one element included in the group of atoms formed by phosphorus, boron, fluorine and silicon.

Another particularly advantageous type of catalyst (particularly as regards improved activity) in hydrorefining contains a partially amorphous Y zeolite, this catalyst will be described later in the second-stage.

In a general manner, the $1^{st}$-stage hydrorefining catalyst contains:

- 5–40% by weight of at least one non-noble element of the groups VIB and VIII (% oxide)
- 0–20% of at least one promoter element chosen from among phosphorus, boron, silicon (%oxide), preferably 0.1–20%; advantageously boron and/or silicon are present, and optionally phosphorus.
- 0–20% of at least one element from group VIIB (manganese for example)
- 0–20% of at least one element from group VIIA (fluorine, chlorine for example)
- 0–60% of at least one element from group VB (niobium for example)
- 0.1–95% of at least one matrix, and preferably alumina The catalysts described above are generally used to provide the hydrorefining also called the hydrotreatment stage. This hydrorefining stage can be followed by an intermediate separation (the unconverted effluent then goes into the second-stage), or all of the effluent leaving the hydrorefining stage is treated by a $1^{st}$ stage hydrocracking catalyst.

This first stage hydrocracking is carried out for example in another reactor or in an additional catalyst bed in the reactor where the hydrorefining takes place. A pre-cracking is then achieved which makes it possible to reach the desired rates of conversion in the first stage. In this first stage hydrocracking stage, the catalyst used possesses at least one hydrodehydrogenating function, a greater acidity making it possible to supplement the pre-cracking. This greater acidity can be provided by an acid solid such as an amorphous silica-alumina or a zeolite. The hydrocracking catalyst is identical to that of the second-stage (as described later) or different and is preferably zeolitic.

Prior to injection of the charge, the catalysts used in the process according to the present invention are preferably subjected beforehand to a sulphurization treatment making it possible to transform, at least in part, the metallic types to sulphur before they are brought into contact with the charge to be treated. This activation treatment by sulphurization is well known to a man skilled in the art and can be carried out by any method already described in literature either in situ, that is to say in the reactor, or ex situ.

A standard method of sulphurization well known to a person skilled in the art consists of heating in the presence of hydrogen sulphide (pure or for example under flux of a hydrogen hydrogen sulphide mixture) to a temperature of between 150 and 800° C., preferably between 250 and 600° C., generally in a crossed bed reaction zone.

In the first stage of the process, the charge is brought into contact, in the presence of hydrogen, with at least one catalyst as previously described, at a temperature of between 330 and 450° C., preferably 360–420° C., preferably 360–420° C., under a pressure of between 5 and 25 MPa, preferably lower than 20 MPa, the spatial velocity being between 0.1 and 6 $h^{-1}$, preferably 0.2–3$h^{-1}$, and the quantity of hydrogen introduced is such that the per litre of hydrogen/litre of hydrocarbon volume ratio is between 100 and 2000 l/l.

During this stage, a substantial reduction in the level of organic nitrogenous and sulphurous compounds and condensed polycyclic aromatic hydrocarbons is achieved. In these conditions, the majority of the organic nitrogenous and sulphurous products of the charge are also transformed into $H_2S$ and into $NH_3$. This operation therefore makes it possible to eliminate two types of compounds which are known to be inhibitors of the zeolitic catalyst.

In the process according to the invention the level of nitrogen organic compounds in the effluent leaving the first stage is lower than 20 ppm by weight and preferably lower than 10 ppm by weight.

This first stage (including hydrorefining and optionally hydrocracking) also makes it possible to carry out a pre-cracking of the charge to be treated.

Advantageously, this adjustment can be carried out by utilizing the nature and the quality of the catalyst(s) used in the first stage and/or the operating conditions of this first stage. In the process according to the invention the conversion, during the first stage, in terms of products with boiling points lower than 340° C., and better, lower than 370° C., is greater than 20% and preferably greater than 30% and in an even more preferred manner between 40 and 60%.

Intermediate Separation

The effluent resulting from this first stage is sent to a means of separation (separating flask for example) the purpose of which is to carry out a separation of the ammonia ($NH_3$) and the hydrogen sulphide ($H_2S$) produced during this first stage. The hydrocarbon effluent produced by this separation will undergo an atmospheric distillation, and in some cases the combination of an atmospheric distillation and a distillation under vacuum. The purpose of the distillation is carrying out a separation between the converted hydrocarbon products, that is to say generally having boiling points lower than 340° C. (and better, lower than 370° C.) and an unconverted liquid fraction (residue).

Advantageously, distillation can be carried out at atmospheric pressure to obtain several converted fractions (petrol, kerosene, gas-oil for example, with a boiling point of at the most 340° C.) and a residue fraction (for example with an initial boiling point greater than 340° C. or even greater than 370° C.).

To improve the separation, distillation under vacuum can be added. This will be the case for example in order to distil diesel more effectively, or also when it is wished to remove a heavy fraction of the residue from the $2^{nd}$-stage passage. The liquid fraction, residue, containing products the boiling point of which is greater than 340° C. or indeed even greater than 370° C. and resulting from the distillation is at least in part and preferably totally introduced into the second-stage of the process according to the invention.

Second-Stage

The residue fraction resulting from the intermediate separation and sent to the second-stage is said to be "clean" that is to say it contains less than 10 ppm by weight of organic nitrogen and less than 10 ppm by weight of organic sulphur, that is to say nitrogen and sulphur included in organic compounds.

According to the invention, at least one nitrogen compound decomposable in ammonia, in the conditions of the second-stage or ammonia direct is added to the charge or injected into the second-stage reactor.

Among the usable nitrogen compounds, there may be cited by way of example and in a non-exhaustive manner, aromatic amines (aniline for example), aliphatic amines (nButylamine for example), pyrroles, pyridines; ureas; nitrated, nitrous or nitroso derivatives; primary, secondary or tertiary amines; compounds with ammonium.

The quality of ammonia ($NH_3$) added to the reactor(s) of the second-stage of the hydrocracking process according to the invention is such that in the said reactor(s) the nitrogen content by weight, expressed in ppm by weight (parts per million) relative to the charge entering the said reactor(s) is greater than 110 ppm and preferably greater than 150 ppm and in an even more preferred manner greater than 200 ppm by weight.

Furthermore, the second-stage catalyst being, for the reaction, sulphurous, it is advisable to keep it in contact with a partial $H_2S$ pressure sufficient to avoid its desulphurization in the presence of hydrogen and at the reaction temperatures. To this end, and in a standard manner, hydrogen sulphide or at least one sulphur compound which decomposes in $H_2S$ in the conditions of the second-stage is added to the charge or directly into the reactor.

There may be cited, as a sulphur compound, dimethyldisulphide (DMDS), carbon disulphide ($CS_2$), organic polysulphides, mercaptans, sulphides, disulphides, oxygenated sulphur compounds, elemental sulphur, dissolved and/or partially in suspension.

The quantity of hydrogen sulphide ($H_2S$) added into the reactors of the second-stage of the hydrocracking process according to the invention corresponds to a sulphur content by weight, expressed in ppm (parts per million) relative to the charge entering the said reactor(s) greater than 20 ppm and preferably greater than 50 ppm and in an even more preferred manner greater than 200 ppm.

The $NH_3$ and $H_2S$ quantities can be regulated throughout the reaction by the operator. When the second-stage comprises several reactors, the addition takes place in at least one reactor (into the charge or directly into the reactor).

Advantageously., the ammonia ($NH_3$) and the hydrogen sulphide ($H_2S$) injected into the second-stage of the hydrocracking process according to the invention come from the recycling of at least part of the ammonia and hydrogen sulphide produced in the first stage of the process and obtained during the intermediate separation.

Advantageously, at least part of the ammonia produced in the first stage and separated will be used as a source of ammonia. This can be the gas containing $NH_3$, $H_2S$, $H_2$ and the light hydrocarbons separated for example in a gas-liquid separator. Advantageously, it can be a more purified gas obtained after washing the first-stage effluent with water, separation of the aqueous phase and stripping of this aqueous phase in such a way as to produce an ammonia gas containing a little hydrogen and a few light gases. This latter embodiment will be described later, with reference to the figures.

The operating conditions used in the second-stage of the process according to the invention are: a temperature greater than 200° C., often between 250–480° C., advantageously between 320 and 450° C., preferably between 330 and 425° C., at a pressure greater than 0.1 MPa, often between 5 and 25 MPa, preferably lower than 20 MPa and even more advantageously greater than 9 MPa, or better than 10 MPa, the spatial velocity being between 0.1 and $20h^{-1}$ and preferably $0.1–6h^{-1}$, preferably $0.2–3h^{-1}$, and the quantity, of hydrogen introduced is such that the litre of hydrogen/litre of hydrocarbon volume ratio is between 80 and 5000 l/l and most frequently between 100 and 2000 l/l.

These operating conditions used in the second-stage of the process according to the invention make it possible to obtain conversion rates per passage, in terms of products having boiling points lower than 340° C. and better, lower than 370° C., greater than 30% and in an even more preferred manner between 40 and 60%.

The second-stage catalyst comprises at least one Y zeolite, at least one matrix and a hydro-dehydrogenating function. Optionally, it can also contain at least one element chosen from among boron, phosphorus and silicon, at least one element from G VIIA (chlorine, fluorine for example), at least one element from G VIIB (manganese for example), at least one element from G VB (niobum for example).

The catalyst contains at least one porous or poorly crystallized oxide-type mineral matrix. There may be cited, as a non-limiting example, aluminas, silicas, silica-aluminas, aluminates, boron aluminium-oxide, magnesium, silica-magnesium, zirconium, titanium oxide, clay, on their own or in a mixture.

The hydro-dehydrogenating function is generally fulfilled by at least one element from group VI B (for example molybdenum and/or tungsten) and/or at least one element from the non-noble VIII group (for example cobalt and or nickel) of the periodic table of elements.

A preferred catalyst essentially contains at least one metal of group VI, and/or at least one non-noble metal from group VIII, the Y zeolite and alumina.

An even more preferred catalyst essentially contains nickel, molybdenum, a Y zeolite and alumina.

In a preferred manner, the catalyst contains at least one element chosen from the group formed by boron, silicon and phosphorus. Advantageously, the catalyst optionally contains at least one element from group VIIA, preferably chlorine and fluorine, optionally at least one element from group VIIB (manganese for example), optionally at least one element from group VB (niobium for example).

The boron, silicon and/or phosphorus can be in the matrix, the zeolite or are preferably deposited on the catalyst and are therefore mainly located on the matrix. A preferred catalyst contains B and/or Si as deposited promoter element preferably also with phosphorus promoter. The quantities introduced are from 0.1–20% by weight of catalyst calculated as oxide.

The element introduced, and in particular the silicon, mainly located on the matrix of the support can be characterised by techniques such as the Castaing microprobe (distribution profile of the various elements), electron microscopy by transmission coupled with an X analysis of the components of the catalysts, or by the establishment of a distribution cartography of the elements present in the catalyst by electron microprobe.

Generally, the $2^{nd}$-stage catalyst advantageously contains:

0.1–80% by weight zeolite Y 0.1–40% by weight of at least one element from groups VIB and VIII (% oxide)

01–99.8% by weight of matrix (% oxide)

0–20% by weight of at least one element chosen from the group formed by P, B, Si (% oxide), preferably 0. 1–20%

0–20% by weight of at least one element from group VIIA, preferably 0.1–20%

0–20% by weight of at least one element from group VIIB, preferably 0. 1–20%

0–60% by weight of at least one element from group VB, preferably 0.1–60%

As far as the silicon is concerned, in the 0–20% range only the added silicon, and not that of the zeolite, is counted.

The zeolite can optionally be doped by metallic elements such as for example metals from the family of rare earths, in particular lanthanum and cerium, or noble or non-noble metals from group VIII, such as platinum, palladium, ruthenium, rhodium, iridium, iron and other metals such as manganese, zinc and magnesium.

Different Y zeolites can be used.

A particularly advantageous H—Y acid zeolite is characterised by different specifications: a global $SiO_2/Al_2O_3$ molar ratio of between about 6 and 70 and in a preferred manner between about 12 and 50: a sodium content lower than 0.15% weight determined on zeolite calcined at 1 100° C.; a crystalline parameter with a lattice-cell between $24.58\times10^{-10}$ m and $24.24\times10^{-10}$ m and in a preferred manner between $24.38\times10^{-10}$ m and $24.26\times10^{-10}$ m; a sodium ion uptake capacity CNa, expressed in grams of Na per 100 grams of modified zeolite, neutralised then calcined, greater than about 0.85; a specific surface determined by the B.E.T. method greater than about 400 $m^2/g$ and preferably greater than 550 $m^2/g$, a water vapour adsorption capacity at 25° C. for a partial pressure of 2.6 torrs (i.e. 34.6 MPa), greater than about 6%, and advantageously, the zeolite has a pore distribution, determined by physisorption of nitrogen, of between 5 and 45% and preferably between 5 and 40% of the total porous volume of the zeolite contained in pores with a diameter of between $20\times10^{-10}$ m and $80\times10^{-10}$ m and between 5 and 45% and preferably between 5 and 40% of the total porous volume of the zeolite contained in pores with a diameter greater than $80\times10^{-10}$ m and generally lower than $1000\times10^{-10}$ m, the rest of the porous volume being contained in pores with a diameter lower than $20\times10^{-10}$ m.

A preferred catalyst using this type of zeolite contains a matrix, at least one dealuminized Y zeolite possessing a crystalline parameter of between 2.424 nm and 2.455 nm preferably between 2.426 and 2.438 nm, a global $SiO_2/Al2O_3$ molar ratio greater than 8, an alkaline-earth metals or alkali cations and/or rare earths cations content such as the $(n\times M^{n+})/Al$ atomic ratio is lower than 0.8 preferably lower than 0.5 or even 0.1, a specific surface determined by the B.E.T method greater than 400 $m^2/g$, preferably greater than 550$m^2/g$, and a water absorption capacity at 25° C. for a P/Po value of 0.2, greater than 6% by weight, the said catalyst also comprising at least one hydro-dehydrogenating metal, and silicon deposited on the catalyst.

In an advantageous embodiment according to the invention, there is used for the hydrocracking (second-stage and/or optionally first-stage) a catalyst comprising a partially amorphous Y zeolite.

By partially amorphous Y zeolite is meant a solid presenting:

i/ a rate of peaks which is lower than 0.40 preferably lower than about 0.30 ii/a crystalline fraction expressed relative to a reference Y zeolite in sodium form (Na) which is lower than about 60%, preferably lower than about 50%, and determined by X-ray diffraction.

Preferably, the solid, partially amorphous Y zeolites involved in the composition of the catalyst according to the invention have at least one (and preferably all) of the following characteristics:

iii/ a global Si/AI ratio greater than 15, preferably greater than 20 and lower than 150, iv/ an $Si/AI^{iv}$ framework ratio greater than or equal to the global Si/AI ratio, v/a porous volume at least equal to 0.20 ml/g, of solid material, a fraction of which, between 8% and 50%, is constituted by pores with a diameter of at least 5 nm (nanometre) i.e. 50 Å.

vi/ a specific surface of 210–800 $m^2/g$, preferably 250–750 $m^2/g$ and advantageously 300–600 $mn^2/g$ The rate of peaks and the crystalline fractions are determined by X-ray diffraction, using, a procedure derived from ASTM method D3906-97<<Determination, of Relative X-ray Diffraction Intensities of Faujasite-Type-Containing Materials>>. Reference may be made to this method for the general conditions of use of the process and, in particular, for the preparation of samples and references.

A diffractogram is composed of lines characteristic of the crystallised fraction of the sample and of a trough, caused essentially by the diffusion of the amorphous or microcrystalline fraction of the sample (a weak diffusion signal is linked to the apparatus, air, sample holder etc.) The rate of peaks of a zeolite is the ratio, in a predefined angular zone (typically 8 to 40° 2θ when the. Kα radiation of copper, 1=0.154 nm is used), the area of the, zeolite rays (peaks) for the global area of the diffractogram (peaks+trough). This peaks/peaks+trough) ratio is proportional to the quantity of crystallized zeolite in the material. To estimate the crystalline fraction of a sample of Y zeolite, the rate of peaks of the sample will be compared with that of a reference considered to be 100% crystallized (NaY for example). The rate of peaks of a perfectly crystallized NaY zeolite is of the order of 0.55 to 0.60.

The rate of peaks of a standard USY zeolite is from 0.45 to 0.55, its crystalline fraction relative to a perfectly crystallized NaY is from 80 to 95%. The rate of peaks of the solid forming the subject of the present invention is lower than 0.4 and preferably lower than 0.35. Its crystalline fraction is therefore lower than 70%, preferably lower than 60%.

The partially amorphous zeolites are prepared according to the techniques generally used for dealuminization, from commercially available Y zeolites, that is to say those which generally have high crystallinity levels (at least 80%). More generally zeolites can be used which have a crystalline fraction of at least 60%, or at least 70%.

The Y zeolites generally used in hydrocracking catalysts are manufactured by modifying commercially available Na-Y zeolites. This modification allows zeolites to be obtained which are called stabilized, ultra-stabilized or even dealuminized. This modification is carried out by at least one of the dealuminzation techniques, and for example by hydrothermal treatment, acid attack. Preferably, this modification is carried out by a combination of three types of operations known to a person skilled in the art: hydrothermal treatment, ion exchange and acid attack.

Another particularly useful zeolite is a globally non-dealuminized and very acid zeolite.

By non-globally dealuminized zeolite is meant a Y zeolite (FAU, structural type faujasite) according to the detailed nomenclature in "Atlas of zeolites structure types", W. M. Meier, D. H. Olson and Ch. Baerlocher, 4th revised Edition 1996, Elsevier. The crystalline parameter of this zeolite may have diminished through extraction of the aluminas of the structure or framework during the preparation but the global $SiO_2/Al2O_3$ ratio has not changed as the aluminas were not extracted chemically. Such a non-globally dealuminized zeolite therefore has a silicon and alumina composition expressed by the global $SiO_2/Al_2O_3$ ratio equivalent to the starting non-globally dealuminized Y zeolite. The values of the parameters ($SiO_2/Al_2O_3$ ratio and crystalline parameter) are given later on. This non-globally dealuminized Y zeolite can be in the hydrogen form or be at least partially exchanged with metallic cations, for example with the aid of cations of the alkaline-earth metals and/or cations of rare earth metals with atomic numbers from 57 to 71 inclusive. A zeolite without rare earths and alkaline-earths will be preferred, likewise for the catalyst.

The non-globally dealuminized Y zeolite generally has a crystalline parameter greater than 2.43 8 nm, a global $SiO_2/Al_2O_3$ ratio lower than 8, a framework $SiO_2/Al_2O_3$ molar ratio lower than 21 and greater than the global $SiO_2/Al_2O_3$ ratio.

The non-globally dealuminized zeolite can be obtained by any treatment which does not extract the aluminas from the sample, such as for example the treatment with water vapour, treatment with $SiCl_4$.

Another type of catalyst which is advantageous for hydrocracking contains an acid amorphous oxide matrix of alumina type doped with phosphorus, a non-globally dealuminized and very acid Y zeolite and optionally at least one element of group VIIA and in particular fluorine.

The invention is not limited to the cited and preferred Y zeolites, but other types of Y zeolites can be used in this process.

Prior to the injection of the charge into the second-stage of the process according to the present invention, the catalyst is subjected to a sulphurization treatment making it possible to transform, at least in part, the metallic types into sulphur before they are brought into contact with the charge to be treated. This treatment of activation by sulphurization is well known to a person skilled in the art and can be carried out by any method already described in literature either in-situ, that is to say in the reactor, or ex-situ.

A standard method of sulphurization well known to a person skilled in the art consists of heating in the presence of hydrogen sulphide (pure or for example under flux of a hydrogen/hydrogen sulphide mixture) to a temperature between 150 and 800° C., preferably between 250 and 600° C., generally in a crossed bed reaction zone.

The effluent leaving the second-stage of the hydrocracking process according to the invention, is subjected to a so-called final separation (for example by atmospheric distillation optionally followed by a distillation under vacuum), in order to separate the gases (such as ammonia ($NH_3$) and hydrogen sulphide ($H_2S$), as well as the other light gases present, the hydrogen and optionally the conversion products . . . ). At least one liquid residue fraction is obtained containing products the boiling point of which is generally greater than 340° C., which is at least in part recycled in the second-stage of the process.

Advantageously (as shown in the figures), the final separation is carried out with the means of intermediate separation when these comprise an atmospheric distillation and optionally distillation under vacuum.

The invention thus also relates to an installation to carry out a two-stage hydrocracking process, the installation comprising:

- at least one first stage hydrorefining reactor (2) comprising at least one catalyst bed to carry out hydrorefining of the charge,
- at least one duct (1) to introduce the charge into the first reactor of the first stage, which is a hydrorefining reactor, at least one duct (3) to carry the hydrogen to said reactor and at least one exit duct (4) for the effluent of the last reactor of the first stage.
- at least one gas-liquid separator (5) to separate the effluent leaving the first stage, at least one gas leaving per duct (6),
- at least one column (8) to separate the products converted during the first stage and thus obtain a residue.
- at least one second-stage hydrocracking reactor (14) comprising at least one catalyst bed to carry out the hydrocracking of at least part of the said residue,
- at least one duct (16) for the introduction of hydrogen into at least the first hydrocracking reactor of the second-stage, at least one exit duct (17) for the second-stage effluent from the last second-stage reactor,
- at least one means of separation (18) to separate the gases of the effluent leaving the last reactor of the second-stage, and at least one column to separate-at least part of said effluent, the converted products and a residue,
- at least one duct (13) to recycle at least part of the residue into the $2^{nd}$ stage hydrocracking reactor (14), the installation also comprises,

- at least one duct (16) for the introduction of ammonia at least into the first reactor of the second-stage.

The gases are separated from the effluent leaving the first stage via the pipe (4) into a gas-liquid separator (5), a separator flask for example. The gases are recovered by a pipe (6) and the resulting liquid effluent by a pipe (7).

Figure 1:
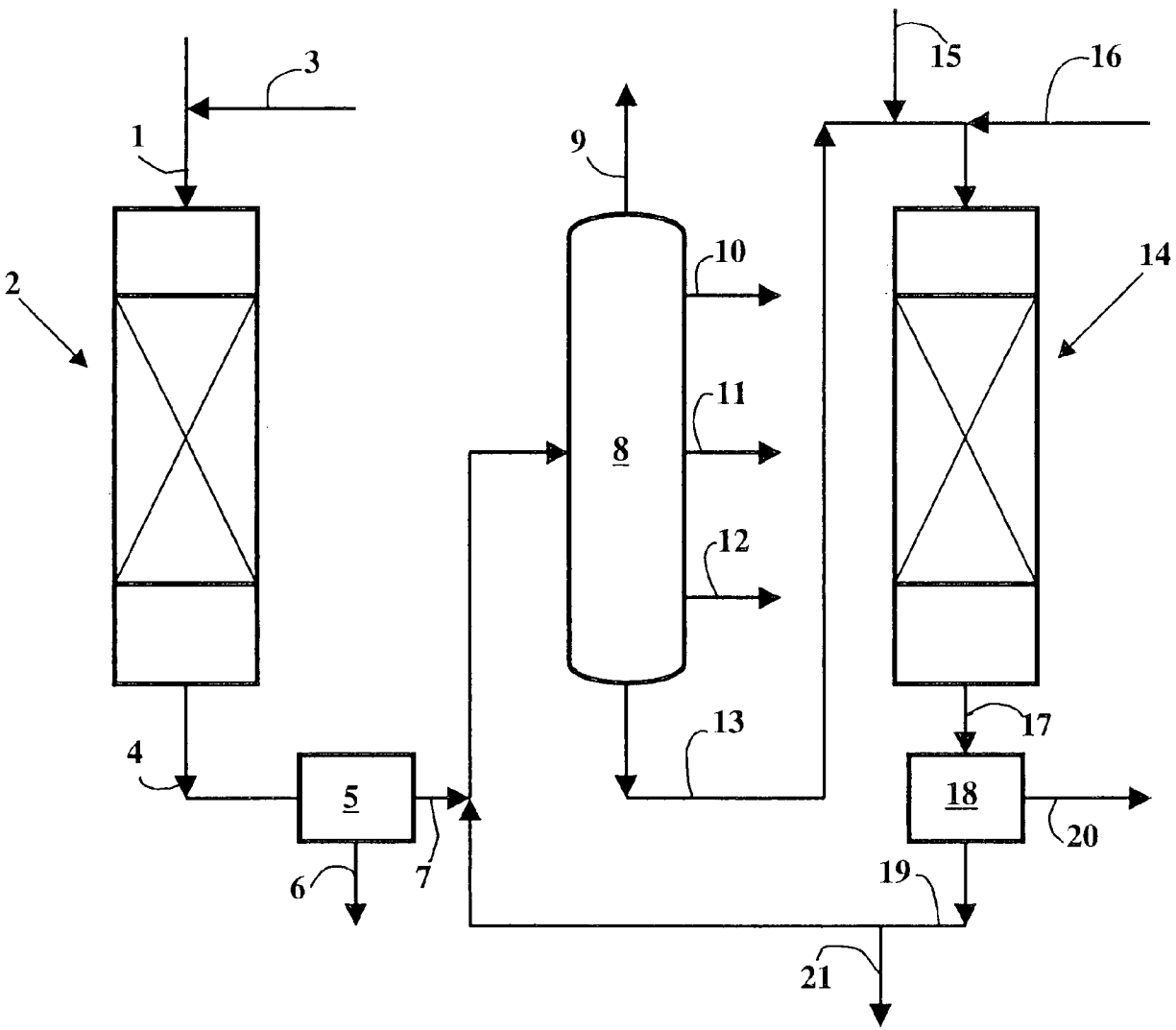
FIG. 1 represents a simplified diagram of the process and the installation

According to the 2-stage process, the liquid effluent is then subjected to an intermediate separation for example in a column (8) so as to separate the converted products which leave in FIG. 1 via the pipes (9) for the light hydrocarbons (C1–C4), (10) for petrol, (11) for kerosene, (12) for gas-oil.

The unconverted effluent (residue) which leaves from the bottom of the column (8) by the pipe (13) is sent at least in part into the second-stage reactor (14) containing at least one bed of hydrocracking catalyst.

Ammonia or an ammonia precursor compound is added to the incoming residue by a pipe (15), and hydrogen (make-up and/or recycled) by a pipe (16).

The gases are separated (pipe 20) into a gas-liquid separator (18) from the effluent leaving the second-stage by a pipe (17). The resulting liquid, leaving by a pipe (19), is generally at least partly recycled into the 2-stage process and preferably into the column (8) so as to separate the products converted during the second-stage. Another part of the liquid cannot be recycled and is removed from the recycling loop, which is called the "bleed" or the purge.

Advantageously, the separators (5) and (18) are supplied with water, and the 3 phases; gaseous, aqueous and organic, are then separated. The gaseous phase essentially comprises hydrogen and constitutes the recycling hydrogen which can very advantageously be used to carry hydrogen into the first and second-stage reactors. In the aqueous phase, the ammonium sulphide is dissolved, and in this manner most of the $NH_3$ and $H_2S$ is eliminated from the recycling gas. The organic phase essentially contains the hydrocarbon products and is sent into the column (8).

Figure 2:
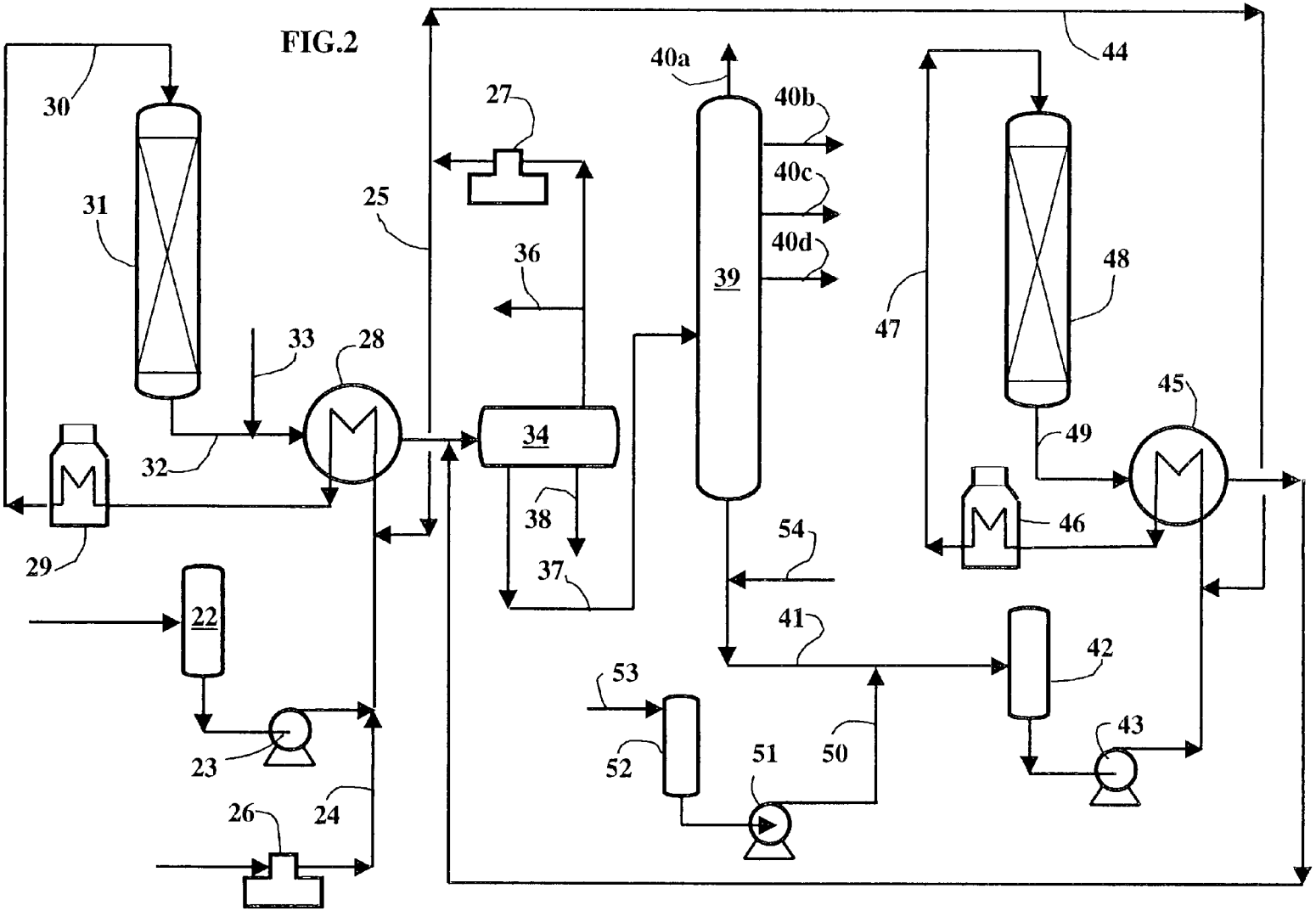
FIG. 2 represents a preferred embodiment

FIG. 2 will show these separators in more detail.

The charge which enters via the pipe (1) (refer to FIG. 2 for the description which follows), is sent for example into a first stage feed flask (22), to be taken up there by the $1^{st}$ stage feed pump (23). It is mixed with the make-up hydrogen carried by the pipe (24) and optionally with the $1^{st}$ stage recycling gas introduced by the duct (25) compressed by the make-up compressor (26) and the recycling compressor (27) respectively. The mixture is advantageously sent successively into a series of $1^{st}$-stage heat exchangers (28), then into the $1^{st}$-stage oven (29) to be brought to the reaction temperature.

It is then introduced by a pipe (30) into one or more $1^{st}$ stage reactors (31) where a hydrorefining takes place optionally followed by a hydrocracking.

The reactor comprises one or more fixed catalytic beds, optionally separated by quench injections (cooling fluid, generally hydrogen). The effluent leaving the reactor via the pipe (32), containing in particular the molecules of ammonia $NH_3$ and hydrogen sulphide $H_2S$ produced, is mixed with washing water introduced by the duct (33). The mixture is cooled in the series of heat exchangers (28) followed optionally by a cooling tower, in order to be collected in a gas-liquid separator flask (34).

3 phases are recovered from this flask:

- a vapour phase, which can be partially purged via a duct (36), and of which at least part can be sent into the reactor by means of the recycling compressor (27) and the duct (25), another part being able to be sent into the second-stage according to the process by the duct (44),
- a hydrocarbon liquid phase (containing the product of the first stage of hydrocracking) which leaves via duct (37),
- and aqueous phase leaving via duct (38), and containing dissolved the ammonium sulphide produced by the reaction:

$$NH_3+H_2S \rightarrow NH_4HS$$

The hydrocarbon liquid 37 is introduced into a distillation line 39. This line consists of one or more distillation columns, and makes it possible to recover the gases, petrol, kerosene and diesel via the pipes 40*a*, 40*b*, 40*c*, and 40*d* respectively. As to the product unconverted by the reaction (residue), it is recovered at the bottom of the column (39), and sent via the pipe (41) into the $2^{nd}$ stage feed flask (42) to be taken up by the second-stage feed pump (43). After mixing with the second-stage recycled hydrogen carried by the pipe (44) through the recycling compressor (27), this fluid is heated by a group of exchangers (45), then an oven (46), to finally be introduced by the pipe (47) into the second-stage reactor (48). Make-up hydrogen can also, if needed, be introduced.

The effluent from this second-stage reactor leaving by pipe (49) is at least partially cooled in the series of exchangers (45), and is sent into the separator flask (34) common to the two-stages.

Middle distillates (kerosene, petrol, gas-oil) and optionally a heavier fraction recovered by a pipe (54) (bleed) on the exit pipe (41) from the final separation unit (column (39) common to the intermediate separation) are thus obtained as exploitable hydrocarbon products.

In the described diagram, the make-up compressor (26), the recycling compressor (27) and the separator flask (34) are common to the two-stages. A particular heat exchange system has been described by way of example in FIG. 2, but all other arrangements are suitable.

According to the process considered, secondary details can vary, such as the relative injection position of the charge, recycling gas and hydrogen make-up gas, the number and the arrangement of the heat exchangers, or the number of reactors, compressors or separating flasks. The two hydrocracking stages can have a common, or separate, recycling compressor and separator flask. These details do not have any effect on the invention described here.

Furthermore, FIG. 2 shows a single $1^{st}$ stage reactor which is therefore a hydrorefining reactor, but several reactors can be used, which can include one or more hydrocracking reactors.

The addition of ammonia according to the invention can be carried out according to various methods.

In a method illustrated in FIG. 2, the necessary quantity of ammonia is injected in the form of a liquid containing a nitrogen compound. This compound is chosen in such a way that in the temperature and pressure conditions inside the reactor, and in the presence of hydrogen, it undergoes a decomposition into ammonia $NH_3$. A compound completely decomposing to $NH_3$ and hydrocarbons will be preferred. Among the usable compounds, aniline or any other compound having the same function in the reaction may be cited.

The decomposition reaction of aniline is written as:

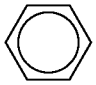

$$NH_2 + 4H_2 \longrightarrow NH_3 + C_6H_{12}$$

This compound is introduced according to FIG. 2 via a duct (50) into the feed flask (42) of the unit. The injection pump (51) and the flask (52) containing nitrogenous liquid fed via duct (53) with nitrogenous liquid compound have also been represented by way of illustration.

The nitrogenous liquid compound can also be introduced at any point of the unit located upstream of the reactor (48), and for example, between the pump (43) and the introduction of hydrogen via the duct (44).

In another method, it is in gaseous form that the nitrogenous compound is introduced into the reaction section. In order to do this, a gas containing ammonia must be available. It is very advisable that the concentration of ammonia in this gas be as high as possible, preferably more than 5% by volume.

Figure 3A:
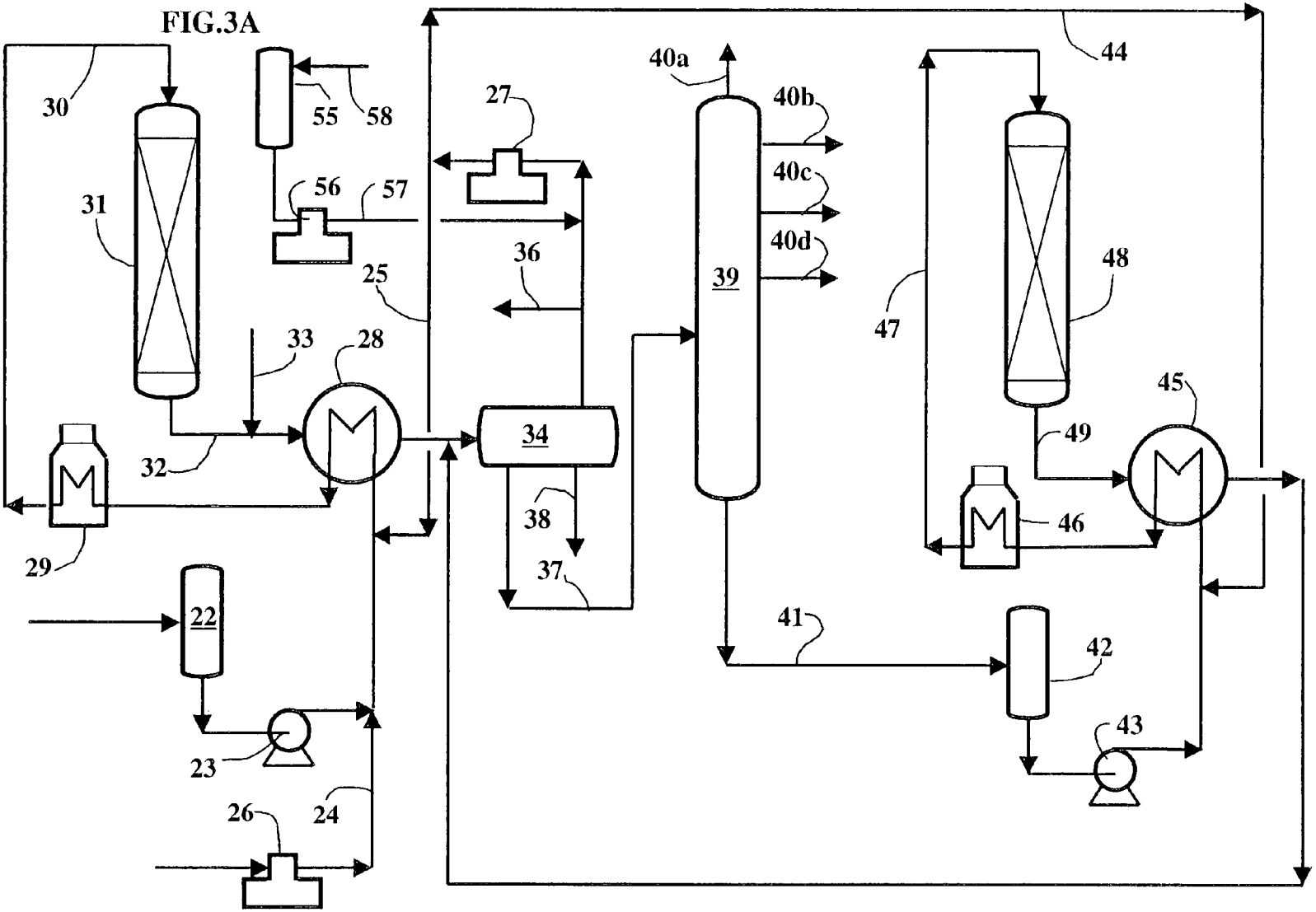
FIGS. 3A, 3B, 3C represent various possibilities for the introduction of ammonia or a precursor of ammonia In FIG. 1, the charge to be treated enters via pipe (1) into the first stage hydrorefining reactor (2) containing at least one hydrorefining catalyst bed. It is mixed with hydrogen carried by a pipe (3). This can be a make-up hydrogen and/or recycled hydrogen, as described in FIG. 2.
Figure 3B:
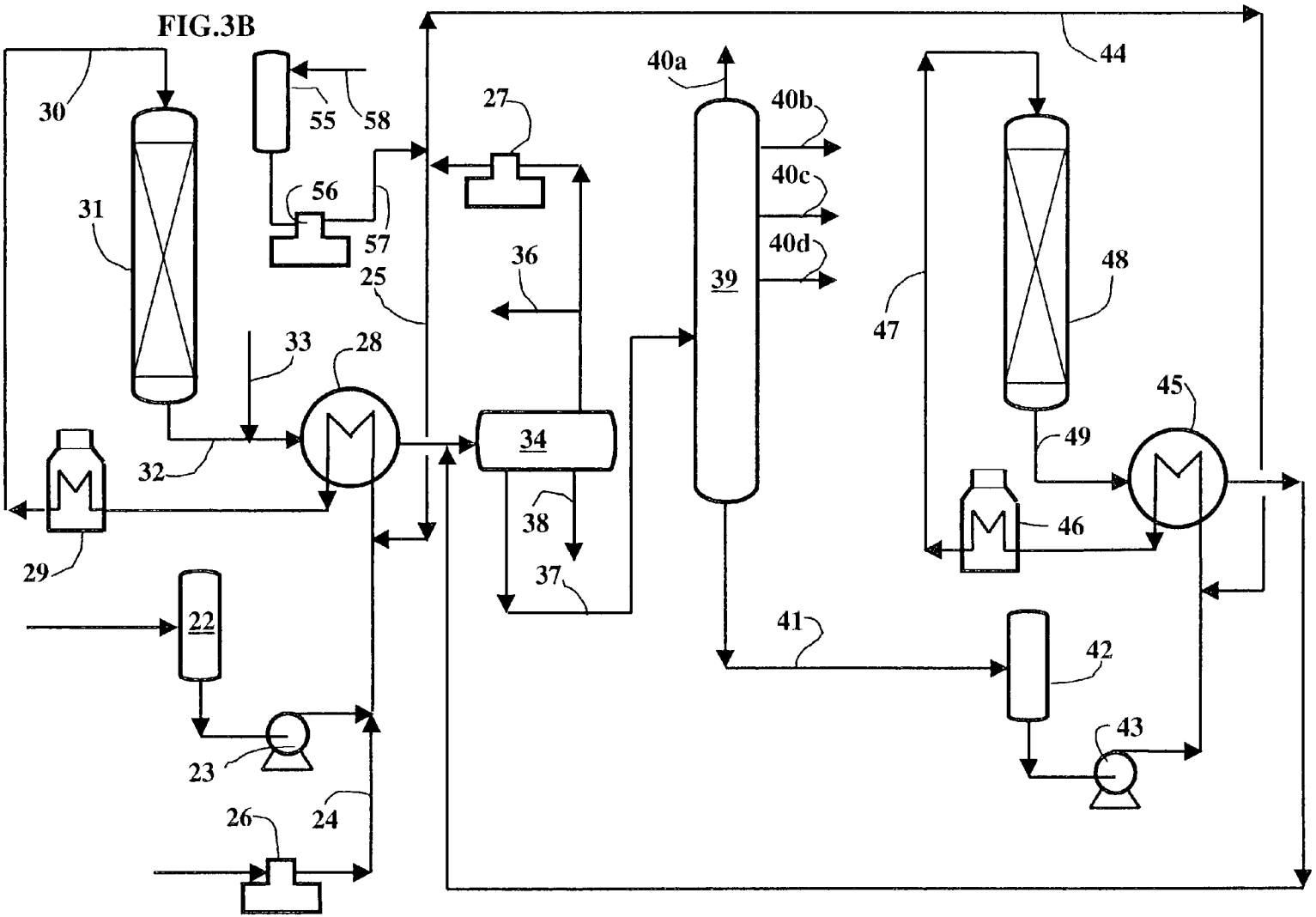
Figure 3C:
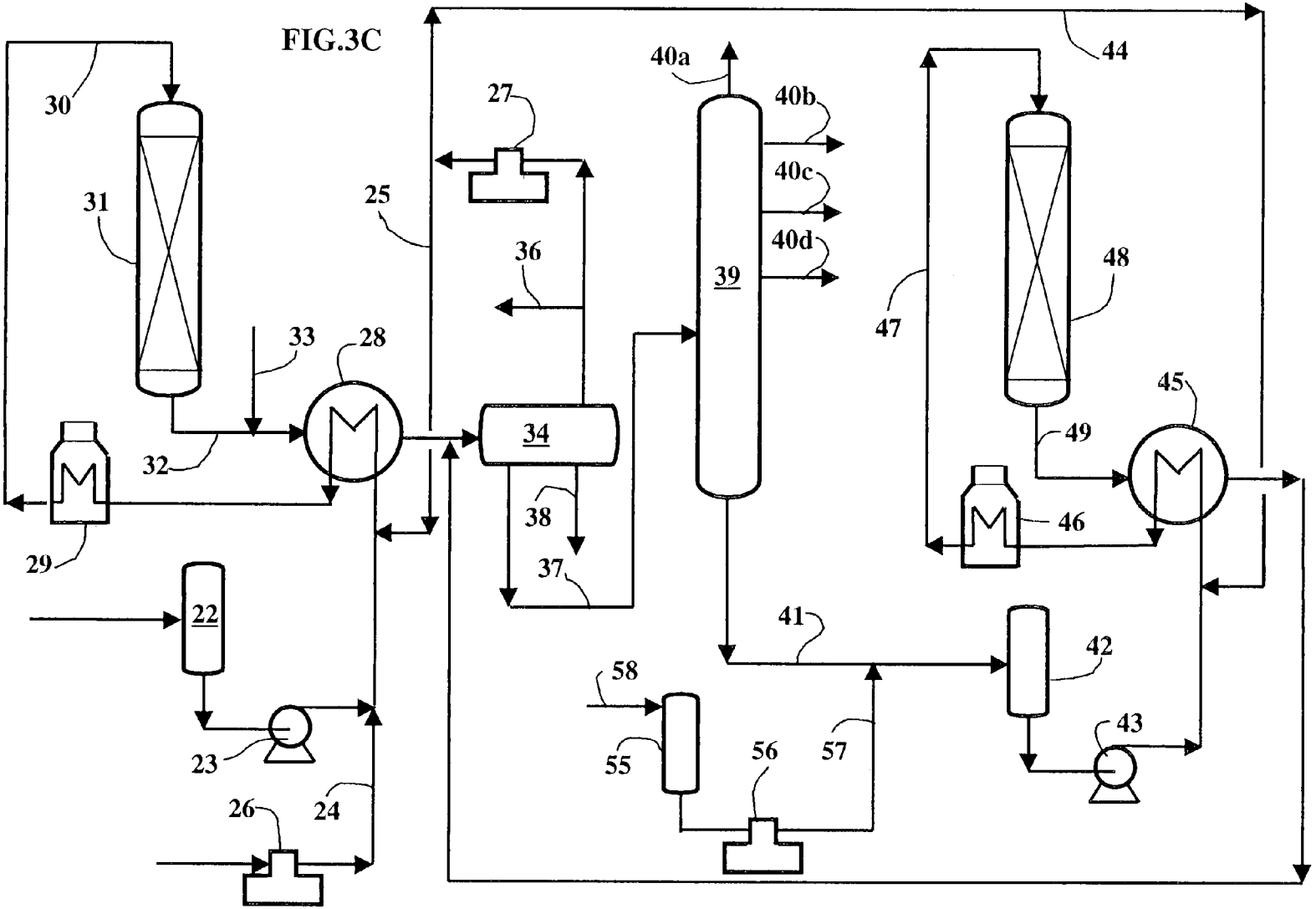

In FIGS. 3A, 3B, 3C different methods of introduction have been represented, the other elements of the figures not included below corresponding to those in FIG. 2.

According to FIGS. 3A, 3B and 3C, this gas is injected into the reaction section via a duct (57), generally by means of a compressor (56), the gas being carried to the compressor via a duct (58), a gas flask (55) being able to be provided. The point of injection can be placed at the intake of the recycling compressor (FIG. 3A), at any point in the high-pressure section (FIG. 3B), and/or in the feed flask (FIG. 3C). The last method is preferred, as it makes it possible to minimise the cost of the ammonia compressor.

More generally, it can be said that the duct (57) introducing the ammonia discharges into the duct (44) recycling the gas coming from the gas-liquid separator in the $2^{nd}$ stage hydrocracking reactor.

Or, according to figure BC, the duct (57) introducing the ammonia discharges into the duct (41) carrying the residue into the $2^{nd}$ stage reactor.

The following examples illustrate the present invention without however limiting its scope.

EXAMPLE 1

Preparation of a $2^{nd}$ Stage Hydrocracking Catalyst Containing a Y Zeolite A dealuminized USY zeolite with a global Si/AI molar ratio equal to 15.2, an Si/AI framework ratio of 29, a crystalline parameter at 24.29 Å containing 0.03% by weight of Na, with a crystalline fraction of 85% is used in this example to prepare the hydrocracking catalyst. The support of the hydrocracking catalyst containing this Y zeolite is manufactured in the following manner:

20 grams of the Y zeolite described above are mixed with 80 grams of a matrix composed of ultra-fine tabular boehmite or alumina gel marketed under the name SB3 by the company Condéa Chemie GmbH. This powder mixture was then mixed with an aqueous solution containing 66% nitric acid by weight then kneaded for 15 minutes. At the end of this kneading, the paste obtained is passed through a die having cylindrical orifices with a diameter equal to 1.4 mm. The extruded material is then dried overnight at 120° C. under air then calcined at 550° C. under air. The extruded material support, containing the Y zeolite, is impregnated dry with an aqueous solution of a mixture of ammonium heptamolybdate, nickel nitrate and orthophosphoric acid, dried overnight at 120° C. under air and finally calcined under air at 550° C. The oxide content by weight of the NiMoPY catalyst that were obtained are shown in table 1.

TABLE 1

Characteristics of the catalyst

| Catalyst | NiMoPY |
|---|---|
| $MoO_3$ (% weight) | 14.1 |
| NiO (% weight) | 3.0 |
| $P_2O_5$ (% weight) | 4.5 |
| $SiO_2$ (% weight) | 14.3 |
| Make up to 100% $AC_2O_3$ (% weight) | 64.1 |

EXAMPLE 2

Preparation of the Second-Stage Charge

The charge of the second-stage is produced by hydrotreatment of a distillate under vacuum on an HR360 catalyst marketed by Procatalyse in the presence of hydrogen, at a temperature of 395° C. and at the hourly spatial velocity of 0.55h-1. The conversion into products at 380° C. is about 50% by weight. After a separation stage, the 380°C.+ fraction is collected and will serve as a charge for the second-stage The physico-chemical characteristics of this charge are the following:

TABLE 2

| characteristics of the second-stage charge | |
|---|---|
| Density (20/4) | 0.853 |
| Sulphur (ppm by weight) | 2.5 |
| Nitrogen (ppm by weight) | 1.4 |
| Simulated distillation | |
| Initial point | 322° C. |
| 5% point | 364° C. |
| 10% point | 383° C. |
| 50% point | 448° C. |
| 90% point | 525° C. |
| Final point | 589° C. |

EXAMPLE 3

Test in the Presence of $NH_3$ According to the Invention

The charge prepared in example 2 is injected into the $2^{nd}$ stage hydrocracking test unit which comprises a fixed-bed reactor, with ascending circulation (<<up-flow>>) of the charge, into which 50 ml of catalyst prepared in example 1 is introduced. Before the injection of the charge the catalyst is sulphurized with a gas-oil+dimethyldisulphide (DMDS)+aniline mixture to 350° C. Once the sulphurization has been carried out, the charge described in table 2 can be treated. The operating conditions of the test unit are the following:

TABLE 3

| Operating conditions | |
|---|---|
| Total pressure | 14 Mpa |
| Catalyst | 50 ml |
| Temperature | 320–420° C. |
| Hydrogen flow rate | 50 I/h |
| Charge flow rate | 50 ml/h |

There are added to the charge described in table 2, a quantity of aniline corresponding to a nitrogen content of 500 ppm by weight and a quantity of DMDS corresponding to a sulphur content of 2000 ppm by weight. The aniline injected into the reactor in the presence of the catalyst, and in the catalytic operating conditions described in table 3, will decompose leading to the formation of ammonia NH, and the DMDS to that of $H_2S$.

The catalytic performances obtained in these conditions are described in table 4 of this example. The catalytic performances are expressed by the temperature needed to reach a crude conversion rate of 70% and by the crude selectivity in respect of 150–380° C. middle distillates for this conversion these catalytic performances are measured on the catalyst only after a stabilisation period, generally at least 48 hours, had been observed.

The crude conversion CC is taken to be equal to:

CC=% by weight at 380° C.$^-$ of the effluent

The crude selectivity CS of middle distillates is taken to be equal to:

CS=[weight of the fraction (150° C.–380° C.) of effluent]/[weight of the 380° C.-fraction of the effluent]*100 in % by weight

EXAMPLE 4

Comparative Test

This test is carried out in the same conditions as that of example 3, except for the quantity of aniline added which corresponds to 100 ppm by weight nitrogen.

TABLE 4

| Results | | |
|---|---|---|
| Nitrogen content of the charge (ppm by weight) | Reaction temperature to reach 70% of CC | CS of 150/380 middle distillates at 70% of CC |
| 100 | 356 | 61 |
| 500 | 378 | 66 |

Table 4 shows that the use of a catalyst comprising a Y zeolite, in the conditions of the two-stage hydrocracking process according to the invention, leads to an iso-conversion of 70% by weight, with a selectivity in respect of middle distillates (150–380° C. fraction) which is clearly improved compared with those recorded in a process not according to the invention (100 ppm by weight nitrogen) whilst still making it possible to use reaction temperatures which are entirely compatible with the duration of industrial cycles.

The examples thus show that the addition of considerable quantities of ammonia into the $2^{nd}$ stage reactor calms the cracking activity of the Y zeolite and thus makes it possible to increase the selectivities in respect of middle distillates. The selectivities achieved are of the same order as those realized with silica-aluminas but with greater activities.

The process according to the invention thus offers to the refiner considerable flexibility between obtaining maximized production of naphtha (with a low nitrogen content in the $2^{nd}$ stage and low conversion in the $1^{st}$ stage) and maximised production of gas-oil (high nitrogen content in the $2^{nd}$ stage and high conversion in the $1^{st}$ stage). This flexibility was not achieved with the silica-aluminas used in the $2^{nd}$ stage.

The invention claimed is:

1. A two-stage hydrocracking process of a hydrocarbon charge for the production of middle distillates comprising a first stage including catalytic hydrorefining, an intermediate separation of resultant hydrorefined products from an unconverted residue, and a second stage of hydrocracking of at least part of the unconverted residue, said second-stage operating in the presence of ammonia in a quantity corresponding to more than 150 ppm by weight nitrogen, and in the presence of a second stage catalyst containing at least one matrix, at least one Y zeolite and at least one hydrodehydrogenating element.

2. A process according to claim 1 in which the second-stage operates in the presence of hydrogen sulphide.

3. A process according to claim 1 in which the quantity of nitrogen in said second stage is about 500 ppm.

4. A process according to claim 3 in which the quantity of nitrogen is greater than 200 ppm.

5. A process according to claim 4 in which the Y zeolite is a hydrogen-form zeolite having a $SiO_2/Al_2O_3$ molar ratio of 6–70, a sodium content lower than 0.15% wt, a crystalline parameter of 2.424–2.458 nm, an Na ion take-up capacity of greater than 0.85, a specific surface greater than 400 $m^2/g$, a water vapour absorption capacity greater than 6% and a pore distribution, determined by nitrogen physisorption, of between 5 and 45% of the total porous volume of the zeolite contained in pores with a diameter of between $20\times10^{-10}$ m and $80\times10^{-10}$ m, and between 5 and 45% of the total porous volume of the zeolite contained in pores with a diameter greater than $80\times10^{-10}$ m, the rest of the porous volume being contained in pores with a diameter lower than $20\times10^{-10}$ m.

6. A process according to claim 1 in which the catalyst of the second stage contains a matrix, at least one dealuminized Y zeolite possessing a crystalline parameter of between 2.424 nm and 2.455 nm, a global $SiO_2/Al_2O_3$ molar ratio greater than 8, alkaline-earth or alkali metals cations and/or rare earths cations content such as the $(n \times M^{n+})/Al$ atomic ratio is lower than 0.8, a specific surface determined by the B.E.T method greater than 400 $m^2/g$, and a water absorption capacity at 25° C., for a P/Po value of 0.2, greater than 6% by weight, the said catalyst also comprising at least one hydrodehydrogenating metal, and silicon deposited on the catalyst.

7. A process according to claim 1 in which the hydrocracking or hydrorefining catalyst comprises at least one matrix, at least one element chosen from the group formed by the elements of group VIII and group VIB, and a partially amorphous Y zeolite presenting:

i/a peak rate which is lower than 0.40 ii/ a crystalline fraction expressed relative to a reference Y zeolite in sodium form (Na) which is lower than about 60%.

8. A process according to claim 1 in which the second stage catalyst contains at least one matrix doped with phosphorus, at least one acidic non-globally dealuminized Y zeolite with a crystalline parameter greater than 2.438 nm, with a global molar ratio $SiO_2/Al_2O_3$ lower than 8, with a framework molar ratio lower than 21 and greater than the global $SiO_2/Al_2O_3$ ratio.

9. A process according to claim 1 in which the second stage catalyst also contains at least one promoter element deposited on the surface of the catalyst and chosen from the group consisting of phosphorus, boron and silicon.

10. A process according to claim 9 in which the second stage catalyst contains as a promoter element boron and/or silicon, and optionally phosphorus.

11. A process according to claim 1 in which the first stage hydrorefining catalyst comprises at least one matrix, at least one hydrodehydrogenating element chosen from non-noble elements of the groups VIIB and VIII, and at least one promoter agent deposited on the catalyst and chosen from phosphorus, boron and silicon.

12. A process according to claim 11 in which the second stage catalyst contains as a promoter agent boron and/or silicon, and optionally phosphorus.

13. A process according to claim 12 in which the catalyst also contains at least one element chosen from the group formed by the elements of groups VIIA, VIIB, VB.

14. A process according to claim 1 in which the first stage is carried out with a conversion rate in terms of products with boiling points lower than 340° C. of between 40 and 60%.

15. A process according to claim 1 in which an unconverted liquid residue containing hydrocarbon products with boiling points greater than 340° C. is separated by distillation.

16. A process according to claim 1 in which the first stage of the process also comprises a hydrocracking stage carried out on a hydrocracking catalyst identical to or different from the second-stage hydrocracking catalyst.

17. A process according to claim 1 in which, before being brought into contact with the hydrocarbon charge, the catalysts are subjected to a sulphurization treatment, and in which the first stage is carried out at 330–450° C., 5–25 MPa, with a spatial velocity of $0.1–6H^{-1}$ and an $H_2$/charge volume ratio of 100–2000 l/l, and the second-stage proceeds at a temperature greater than 200° C., at a pressure greater than 0.1 MPa, with a spatial velocity of $0.1–20^{h-1}$ and $H_2$/charge volume ratio of 80–5000 l/l.

18. A process according to claim 1 in which the second-stage is kept in contact with a partial $H_2S$ pressure by adding to the charge or directly into the reactor hydrogen sulphide or at least one sulphur compound which decomposes in $H_2S$ in the conditions of the second-stage.

19. A process according to claim 18 in which the quantity of hydrogen sulphide added corresponds to a sulphur content by weight, relative to the charge entering the second stage greater than 20 ppm.

20. A process according to claim 1 wherein the second stage catalyst contains a matrix of alumina gel or boehmite, a Y zeolite, $MoO_3$, NiO, $P_2O_5$ and $SiO_2$.

21. A process according to claim 5 wherein the second stage catalyst contains a matrix of alumina gel or boehmite, a Y zeolite, $MoO_3$, NiO, $P_2O_5$ and $SiO_2$.

22. A process according to claim 6 wherein the second stage catalyst contains a matrix of alumina gel or boehmite, a Y zeolite, $MoO_3$, NiO, $P_2O_5$ and $SiO_2$.

23. A process according to claim 7 wherein the second stage catalyst contains a matrix of alumina gel or boehmite, a Y zeolite, $MoO_3$, NiO, $P_2O_5$ and $SiO_2$.

24. A process according to claim 8 wherein the second stage catalyst contains a matrix of alumina gel or boehmite, a Y zeolite, $MoO_3$, NiO, $P_2O_5$ and $SiO_2$.

* * * * *